US007994700B2

(12) United States Patent
Saruta

(10) Patent No.: US 7,994,700 B2
(45) Date of Patent: Aug. 9, 2011

(54) IMAGE DISPLAY APPARATUS

(75) Inventor: Shoshiro Saruta, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/390,287

(22) Filed: Feb. 20, 2009

(65) Prior Publication Data

US 2009/0212682 A1 Aug. 27, 2009

(30) Foreign Application Priority Data

Feb. 21, 2008 (JP) ..... 2008-040110

(51) Int. Cl.
*H01J 1/62* (2006.01)

(52) U.S. Cl. ..... 313/496; 313/485; 313/495

(58) Field of Classification Search ..... 313/495–497, 313/30–311, 485–487
See application file for complete search history.

(56) References Cited

U.S. PATENT DOCUMENTS 5,936,342 A 8/1999 Ono et al.
6,384,542 B2 5/2002 Tsukamoto
2006/0132024 A1* 6/2006 Nanataki et al. ..... 313/497
2006/0290269 A1* 12/2006 Fukuda et al. ..... 313/503
2007/0029525 A1* 2/2007 Gotoh et al. ..... 252/301.4 F

FOREIGN PATENT DOCUMENTS

| | | |
|---|---|---|
| CN | 1921171 | 2/2007 |
| CN | 101075401 | 11/2007 |
| EP | 1790709 A1 | 5/2007 |
| JP | 2006-070239 A | 3/2006 |
| JP | 2006-140001 | 6/2006 |
| JP | 2007-329027 | 12/2007 |

* cited by examiner

*Primary Examiner* — Bumsuk Won
(74) *Attorney, Agent, or Firm* — Canon U.S.A., Inc., IP Division

(57) ABSTRACT

An image display apparatus includes a rear plate having a plurality of electron-emitting devices, a face plate having a plurality of pixels, each pixel having one or more phosphors that emit fluorescence in response to electrons emitted from the electron-emitting devices, and a drive circuit for driving the electron-emitting devices. At least one of the phosphors is $CaAlSiN_3:Eu^{2+}$; and the electrons are supplied to the pixels for 2 μs to 70 μs from the electron-emitting devices on a scan basis, each of which devices supplies current to one or more of the phosphors.

7 Claims, 2 Drawing Sheets

IMAGE DISPLAY APPARATUS

BACKGROUND OF THE INVENTION

1. Field of the Invention

The present invention generally relates to an image display apparatus.

2. Description of the Related Art

There has recently been increasing demand for image display apparatus (e.g., displays) that show additional improvements in their performance, size, and image quality, in association with the diversification and densification of image information. In particular, with the growing concern for energy savings and space savings, there has been a shift from demand for image display apparatus that use a cathode ray tube, called a Braun tube, to a demand for flat panel displays. Hereinafter, the cathode ray tube is abbreviated as "CRT", and the flat panel display is abbreviated as "FPD".

Examples of the FPD include a liquid crystal display, a plasma display and a field emission display (hereinafter abbreviated as "FED"). The FED is an image display apparatus that generally operates on the following principle: fine electron-emitting devices, the number of which is equal to that of the pixels, are placed on a substrate, and electrons are emitted from the electron-emitting devices into a vacuum, and are caused to impinge on a phosphor to cause the phosphor to emit light. Each of the electron-emitting devices corresponds to the electron gun of a Braun tube, and can realize a fairly bright image having a sufficiently high contrast on a relatively large flat panel display, as in the case of a CRT, and thus the FED is expected to show promise as a next-generation self light-emitting FPD.

An available technique for producing an FED involves the use of, for example, an electron-emitting device of a type called a Spindt type in which an electron is emitted from the tip of the cone of a conical emitter, or a device of a planar structure called a surface-conduction electron-emitter. Hereinafter, the surface-conduction electron-emitter is abbreviated as "SCE", and a surface-conduction electron-emitter display is abbreviated as "SED".

In an FED of such a type that a phosphor is caused to emit light by accelerating an electron at a relatively high voltage, a P22 type phosphor for a conventional CRT is often used, either as it is or after a certain improvement.

For example, in an FED of such a type that a phosphor is caused to emit light by accelerating an electron at a relatively high voltage, ZnS:Ag (blue phosphor), ZnS:Cu (green phosphor) and $Y_2O_2S:Eu^{3+}$, referred to as YOS hereinafter (red phosphor) are generally used, and are also called P22 type phosphors, each of which has established some achievement in CRT applications.

However, when one tries to display a high definition television (HDTV) image with an FED using a P22 type phosphor, the resulting motion image may be inferior in visibility as compared to that in the case of a CRT type image display apparatus.

SUMMARY OF THE INVENTION

According to one aspect of the present invention, there is provided an image display apparatus including a rear plate having a plurality of electron-emitting devices, a face plate having a plurality of pixels, each pixel having one or more phosphors that emit fluorescence in response to electrons emitted from the electron-emitting devices, and a drive circuit for driving the electron-emitting devices. At least one of the phosphors is $CaAlSiN_3:Eu^{2+}$, and the electrons are supplied to the pixels for 2 μs to 70 μs from the electron-emitting devices on a scan basis, each of which devices supplies current to one or more of the phosphors.

According to another aspect of the present invention, there is provided an image display apparatus including a rear plate having a plurality of electron-emitting devices, a face plate having a plurality of pixels, each pixel having one or more phosphors that emit fluorescence in response to electrons emitted from the electron-emitting devices, and a drive circuit for driving the electron-emitting devices. In at least one pixel of the pixels, a first phosphor and a second phosphor are layered on a substrate of the face plate in order of the second phosphor and then the first phosphor, the first phosphor emits fluorescence in response to the electrons emitted from the electron-emitting devices, and the second phosphor emits, in response to the fluorescence emitted from the first phosphor, a visible light by which the pixel forms an image. The second phosphor may be $CaAlSiN_3:Eu^{2+}$.

According to another aspect of the present invention, there is provided a field emission display including a rear plate having a plurality of wires, each wire being connected to a plurality of electron-emitting devices; a face plate having a plurality of pixels, each pixel having an illuminant that emits light in response to electrons emitted from the electron-emitting devices; and a drive circuit that sequentially selects a wire from the wires and applies a scanning signal to the wire to drive the electron-emitting devices. The illuminant comprises $CaAlSiN_3:Eu^{2+}$, and the electrons, emitted from at least one of the electron-emitting devices electrically connected to the wire selected to apply the scanning signal, irradiate the illuminant for 2 μs to 70 μs during a period that the scanning signal is applied to the wire selected.

Further features of the present invention will become apparent from the following description of exemplary embodiments with reference to the attached drawings.

DESCRIPTION OF THE EMBODIMENTS

Figure 1:
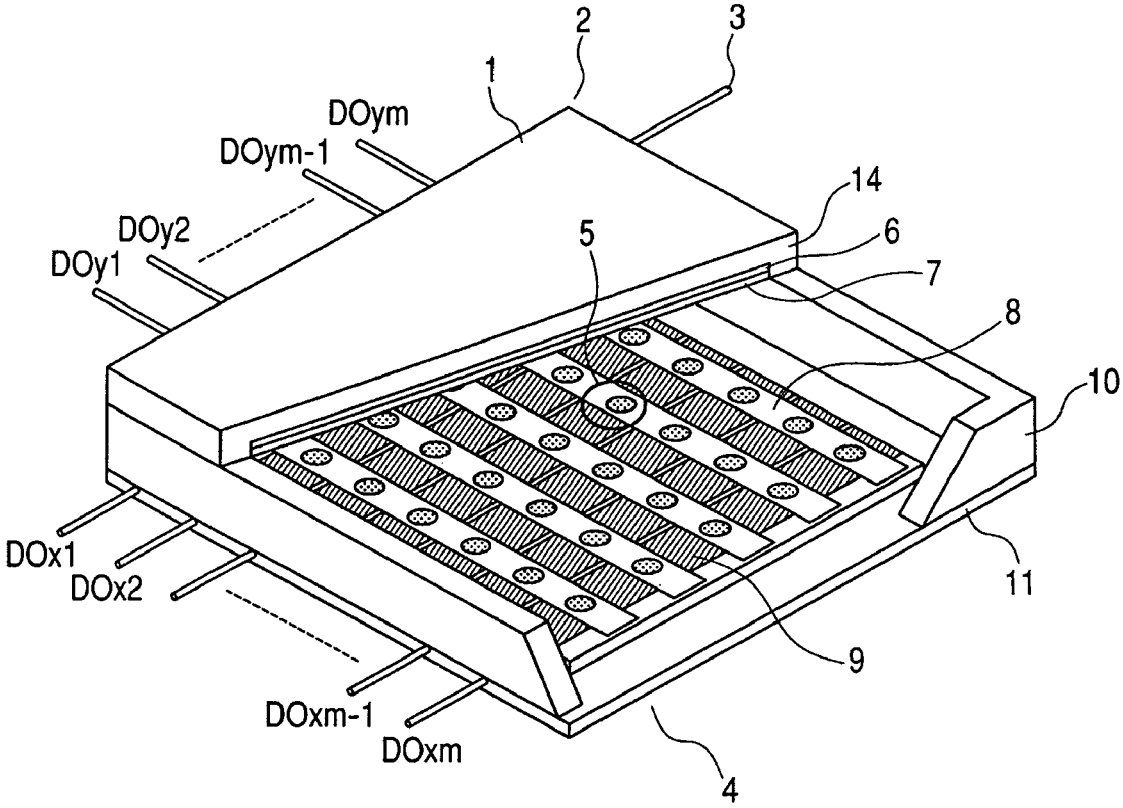
FIG. 1 is a perspective view of an embodiment of an FED according to the present invention.

The inventor has conducted extensive studies to discover the reason why an HDTV motion image displayed on an FED using a P22 type phosphor as an illuminant is typically inferior in visibility to that displayed on an image display apparatus using a CRT.

It is noted that a difference in structure between the CRT and the FED is typically as follows: while a gap between an electron-emitting device and a plate onto which a phosphor is applied is typically several tens of centimeters in the CRT, a gap between a rear plate on which an electron-emitting device is formed and a face plate onto which the phosphor is applied is typically suppressed to several millimeters or less in the FED because of reasons concerning, for example, the convergence of a beam.

Thus, an FED may typically have a narrower gap between an electron-emitting device and a phosphor than a CRT does. The narrow gap imposes a considerable restraint on a discharge resistance, thereby precluding the application of an accelerating voltage to be typically used in a CRT. Accordingly, even an FED of a high-field type is generally driven at an accelerating voltage of about 15 kV or less, while the CRT is driven at an accelerating voltage of 25 kV or more. The reason for the foregoing results from a restraint on a discharge resistance due to the relatively narrow gap between the electron-emitting device and the phosphor.

Also, the CRT can typically be driven at a sufficient accelerating voltage, so that the diffusion length of an electron that penetrates into a phosphor layer can be sufficiently long. As a result, the CRT can adopt "dot-sequential driving," in which a pixel is updated with a "dot". In contrast, in the case of a display that cannot be driven at such a sufficient accelerating voltage, like the FED, the diffusion length of an electron may become shorter than that in the case of the CRT, and thus the display may adopt "line-sequential driving," in which the pixels are collectively updated for each scanning line.

In the case of the line-sequential driving, a phosphor may be exposed to a relatively high charge density per unit time, and may light for a relatively long time period as compared to those in the case of the dot-sequential driving.

The inventor has discovered that at least one of the reasons for the inferiority of the FED in motion image visibility as compared to the CRT is due to the use of $Y_2O_2S:Eu^{3+}$ as a P22 type phosphor, which phosphor has been widely used as a red phosphor for a middle-high speed type FED. Despite its widespread use, the inventor has unexpectedly discovered that when a P22 type $Y_2O_2S:Eu^{3+}$ red phosphor is used in an FED that adopts the line-sequential driving, the red phosphor is inferior to blue and green phosphors in both (1) luminance linearity in a high charge density region and (2) emission attenuation.

In particular, the P22 type red phosphor $Y_2O_2S:Eu^{3+}$ has been discovered to exhibit problems such as a reduction in motion image-displaying performance due to residual light visibility and a reduction in gradation-representing performance, because the red phosphor is poor in luminance linearity in a high charge density region, and because with regard to emission attenuation, the red phosphor has a 1/10 attenuation time of about 1 ms, which is extremely long as compared to the selection time of line-sequential driving. Thus, the inventor has found that motion image visibility can be enhanced by using an improved phosphor having linearity in a high charge density region, and an emission attenuation time, each of which is comparable to those of the blue and green phosphors.

According to one aspect, the inventor of the present invention has unexpectedly found that conditions under which the phosphor $CaAlSiN_3:Eu^{2+}$, which is disclosed in Japanese Patent Application Laid-Open No. 2006-070239, shows a higher luminance than $Y_2O_2S:Eu^{3+}$, include the following: when $CaAlSiN_3:Eu^{2+}$ has a selection time equal or close to that of continuous irradiation under an accelerating voltage of 25 kV. The europium-activated calcium aluminum silicon nitride phosphor ($CaAlSiN_3:Eu^{2+}$, hereinafter "CASN") can thus show a higher luminance than a europium-activated yttrium oxysulfide phosphor ($Y_2O_2S:Eu^{3+}$), to provide improved results for FED displays.

In one embodiment, the inventor has found that an improved display apparatus can be provided as follows: $CaAlSiN_3:Eu^{2+}$ is used as at least one phosphor for an FED that includes a rear plate having a plurality of electron-emitting devices, a face plate having a plurality of pixels, each pixel having one or more phosphors that emit fluorescence in response to electrons from the electron-emitting devices, and a drive circuit for driving the electron-emitting devices. The electrons are supplied to the pixels on which $CaAlSiN_3:Eu^{2+}$ is formed for 2 μs to 70 μs from the electron-emitting devices, each of which supplies current to one or more of the phosphors on a scan basis.

In one version, because $CaAlSiN_3:Eu^{2+}$ is a red phosphor, other colors can be displayed by further using, for example, blue and green phosphors. For example, in addition to the red phosphor, the pixel may also optionally have at least one of a blue phosphor that emits blue emission and a green phosphor that emits green emission, in response to the electrons emitted from the electron-emitting devices.

Furthermore, in another embodiment, an image display apparatus in accordance with the invention comprises: in at least one pixel, a first phosphor and a second phosphor that are layered on substrate of the face plate in order of the second phosphor and then the first phosphor, where the first phosphor emits fluorescence in response to the electrons emitted from the electron emitting devices, and the second phosphor emits, in response to the fluorescence emitted from the first phosphor, a visible light by which the pixel forms an image, and where the second phosphor is $CaAlSiN_3:Eu^{2+}$.

In one version, the first phosphor may be a phosphor of a complex (e.g., mixed) alkali earth silicate represented by the general formula $M1_lM2_mSi_2O_6:EU^{2+}$, where M1 and M2 each represent any of Ba, Sr, Ca and Mg, and $1<l+m<3$.

For example, the first phosphor may be any of $Ca_lMg_mSi_2O_6:Eu^{2+}$, $Sr_lMg_mSi_2O_6:Eu^{2+}$, $Ba_lMg_mSi_2O_6:Eu^{2+}$, $Sr_lCa_mSi_2O_6:Eu^{2+}$, $Ba_lCa_mSi_2O_6:Eu^{2+}$ and $Ba_lSr_mSi_2O_6:Eu^{2+}$.

In one version, with the above-mentioned layered structure, the first phosphor receives an electron and emits light having a wavelength that is within a range of from a near-ultraviolet region to a visible region. Since the second phosphor receives the light having a wavelength that is within a range of from a near-ultraviolet region to a visible region emitted from the first phosphor, an emission intensity of the second phosphor can be thereby increased as compared to the emission intensity that would otherwise occur in a case where the second phosphor receives an electron.

Thus, in one version, the wavelength band of the fluorescence of the first phosphor that occurs upon receiving the electron may be a wavelength band that corresponds to the excitation band of the second phosphor. That is, the fluorescence of the first phosphor emitted in response to the electrons has a wavelength that is within the excitation band of the second phosphor. In one version, the luminance of the second phosphor that is emitted in response to the emission by the first phosphor, is greater than what the luminance of the second phosphor would otherwise be, if the luminance were instead emitted in response to the second phosphor receiving the electrons.

Furthermore, in one version, one or more colors can also be displayed by using one or a combination of blue and green phosphors, as described above.

Hereinafter, a first embodiment of the present invention will be described in detail.

The arrangements of an embodiment of a field emission display (FED) panel according to the present invention, and an embodiment of a field emission display (FED) according to the FED panel of the present invention, will be described with reference to the schematic view shown in FIG. 1.

FIG. 1 shows a schematic view of an embodiment of an FED panel 2. In the embodiment as shown, the panel includes a face plate 1 and a rear plate 4. The face plate 1 and the rear plate 4 may be sealed through a side wall 10, and the pressure in the sealed internal space may be reduced to, for example, about $10^{-5}$ Pa or less. Hereinafter, the foregoing state may be referred to as "vacuum state".

Although the side wall 10 is provided separately from the face plate 1 and the rear plate 4 in the version as shown here, the side wall 10 may also optionally be of such a structure as to be integrated with the face plate 1 or the rear plate 4.

In the embodiment as shown, the rear plate 4 includes a rear-side substrate 11, multiple signal lines 9, multiple scanning lines 8, multiple electron-emitting devices serving as electron-emitting sources, and terminals D0x1 to D0xm and D0y1 to D0ym.

According to this embodiment, the multiple signal lines 9 and the multiple scanning lines 8 may be formed on the rear-side substrate 11, which may comprise a transparent material, such as for example glass, through an insulating film (not shown). The rear plate 4 may also have the electron-emitting devices connected to the signal lines 9 and the scanning lines 8 at the points of intersection of the signal lines 9 and the scanning lines 8. In the figure as shown, reference numeral 5 represents the position at which an electron-emitting device may be provided, as described in more detail below.

In one version, although not shown in FIG. 1, the signal lines 9 and the scanning lines 8 may be formed through the insulating film.

In the embodiment as shown, the terminals D0x1 to D0xm are terminals for applying voltages from the outside to the signal lines 9, and the terminals D0y1 to D0ym are terminals for applying voltages from the outside to the scanning lines 8.

According to this embodiment, the face plate 1 may include a face-side substrate 14, a fluorescent screen 6 comprising one or more phosphors (e.g., a screen on which phosphors are formed), a metal back 7 and a high-voltage terminal 3. In the face plate 1, the fluorescent screen 6 comprising the phosphors is provided (e.g., formed) on the face-side substrate 14 formed of, for example, glass, and the metal back 7 is provided (e.g., formed) on the fluorescent screen 6. The high-voltage terminal Hv3 may be connected to the metal back 7.

In one version, the metal back 7 functions as an anode.

In an embodiment of the image display apparatus using the FED panel 2, the signal lines 9 and scanning lines 8 of the FED panel 2 are connected to a drive circuit. The drive circuit receives an image signal (not shown) input to itself to output a voltage corresponding to the image signal to each of the signal lines 9 and the scanning lines 8. The drive circuit is disclosed in U.S. Pat. Nos. 5,936,342 and 6,384,542, which are hereby incorporated by reference herein in its entirety.

In one version, in response to the voltage output from the drive circuit, a relatively high electric field is applied between an electron-emitting device formed at a point of intersection of wires and the metal film (i.e., the metal back 7), the metal film serving as an anode to which a relatively high voltage (accelerating voltage) is applied, and an electron is thereby emitted from the electron-emitting device. The electron emitted from the electron-emitting device impinges on the metal back 7, and the phosphor provided between the metal back 7 and the glass substrate 14 is thereby caused to emit fluorescence to the outside through the glass substrate 14. As a result, an image may be formed on the FED panel 2.

In one version, at least one of a surface-conduction electron-emitter (SCE), a Spindt type electron-emitting device, an MIM type electron-emitting device, a device using a carbon nanotube (CNT) as an emitting portion, and the like, can be used as one or more of the electron-emitting devices. For example, in one version the surface-conduction electron-emitter, which can be relatively easily produced, can be suitably used as one or more of the electron-emitting devices of the image display apparatus according to an embodiment of the present invention.

Figure 2:
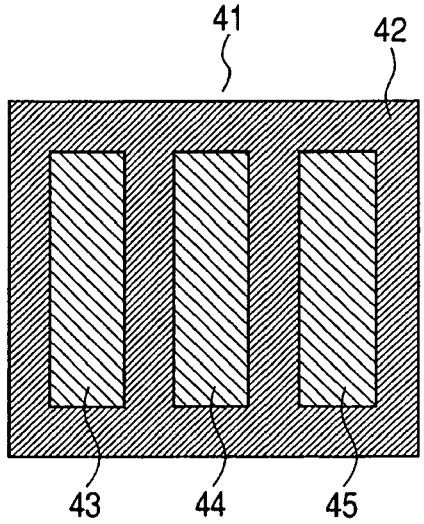
FIG. 2 is a schematic view showing an embodiment of an arrangement of a pixel.

An embodiment of an arrangement of the phosphors will be described with reference to FIG. 2, which is an enlarged plan view of a portion of an embodiment of a fluorescent screen 41, as viewed from the side corresponding to the rear plate 4. Because color display is generally performed by using three colors, i.e., red (R), green (G) and blue (B) colors, description will be given in this embodiment by taking the case where the three colors, i.e., R, G and B colors are used as an example.

It should also be noted that, in one version, the phosphor may optionally be of only one kind when display is performed using only one color.

In the embodiment as shown, the fluorescent screen 41 includes a red (R) phosphor 43, a green (G) phosphor 44, a blue (B) phosphor 45 and a black matrix 42, and may be provided on the face-side substrate (e.g., face-side substrate 14 as shown in FIG. 1).

In the fluorescent screen 41, the red (R) phosphor 43, the green (G) phosphor 44 and the blue (B) phosphor 45 are formed in apertures formed in the black matrix 42 provided on the face-side substrate (not shown) The combination of the red (R) phosphor 43, the green (G) phosphor 44 and the blue (B) phosphor 45 provided in the black matrix 42 may be referred to as a pixel, which is the minimum unit for performing color display. Furthermore, each of the red, blue and green cells may be referred to as "sub-pixel". In one version, the area provided for one pixel may be determined by the number of pixels and the size of a display surface.

In one version, the black matrix 42 may be black to reduce or prevent the occurrence of wraparound to an adjacent phosphor that may occur when the position to which an electron is actually applied deviates to some extent from the position to which the electron is intended to be applied, and/or to reduce or prevent the reflection of external light to inhibit a reduction in display contrast. Furthermore, a conductive material may be used in the black matrix in order that a phosphor may be prevented from charging up by inhibiting charging up caused by an electron.

In one version, graphite can be used as a main component for the black matrix. In another version, a material other than graphite may be used.

Each of the phosphors and the black matrix 42 may be formed by, for example, screen printing.

In addition, the shape of each of the sub-pixels to be arrayed is not limited to a stripe shape as shown, but instead the sub-pixels may also optionally be arrayed in another shape.

According to one version, when the FED panel having the arrangement shown in FIG. 1 is driven, the maximum of a max time t (sec) for which a signal can be applied to one scanning line on a scan basis, is given by the following equation (1), where the number of scanning lines is represented by n, and a frame frequency is represented by f. The max time may also be referred to as the "line selection time" or the "scanning line selection time".

$$t=C1/(f\cdot n) \quad (1)$$

In the equation (1), C1 represents a constant dependent on the mode according to which the FED panel is driven, and is 1 for progressive driving or 2 for interlace scanning.

As an example, in the case of an HDTV 1080i, the FED panel may be driven according to interlace scanning in which the number of scanning lines is 1,080 and a frame frequency is 29.97 Hz, and thus a line selection time may be about 61.8

μs. As another example, when the FED panel is driven with a personal computer (PC), the panel may be driven according to progressive scanning in which a frame frequency is 60 Hz, and thus a line selection time may be about 15 μs.

In a second embodiment of the present invention as described below, the phosphors in the FED panel 2 may adopt a layered structure.

In the second embodiment, a first phosphor that receives an electron emitted from an electron-emitting device and emits fluorescence, and a second phosphor that receives the fluorescence emitted from the first phosphor and emits that causes a pixel to form an image, are layered on the face-side substrate 14 in order of the second phosphor and the first phosphor.

EXAMPLES

Hereinafter, the present invention will be described in detail by way of a comparative example and specific examples.

An FED panel 2 used in each of the comparative example and the examples below is the embodiment of the FED panel 2 the arrangement of which has been described with reference to FIG. 1. Hereinafter, en example of a method of producing the FED panel 2 will be described.

First, a method of producing a face plate 1 using aluminum in the metal back 7 will be described with reference to the example of production flow shown in FIG. 3.

First, an alkali component is precipitated by heating a soda lime glass substrate 14 in an air atmosphere at 550° C. for one hour in a baking process 19.

Cleaning 20 of the glass substrate is performed by cooling the substrate to room temperature, dipping the substrate an aqueous solution of a neutral detergent for cleaning, and further, having the substrate subjected to, for example, ultrasonic rinsing in pure water to a sufficient extent, and then drying it.

Next, a substrate on which a black matrix having apertures therein is formed can be obtained by setting the glass substrate in a screen printing machine, performing screen printing with a black pigment paste through a patterned emulsion plate, performing black matrix printing 21 through drying and baking, and, after the drying, heating it at 550° C. for one hour in a baking process 22.

Next, phosphors are formed in the apertures formed in the black matrix.

First, a blue phosphor is loaded into a lidded Teflon container, and is subjected to metering 23. Next, a terpineol solution in which ethylcellulose is dissolved at a high concentration and terpineol for viscosity adjustment are added in appropriate amounts to the container, and the contents in the container are subjected to paste adjustment 24. After that, the resultant mixture is subjected to kneading 25 with a roll mill apparatus, and, furthermore, is subjected to defoaming 26 with a planetary stirring machine, whereby a blue phosphor paste can be obtained.

Next, the above glass substrate is set in the screen printing machine again, and is subjected to phosphor film printing 27, drying 28 and baking 29 with the above blue phosphor paste through a patterned emulsion plate. As a result, the blue phosphor can be applied to an aperture of the black matrix.

Similarly, the green and red phosphors can be applied to apertures of the black matrix by repeating steps 23 to 29 using green and red phosphors.

Subsequently, the above-mentioned substrate is placed on a spin coater, and its surface is made sufficiently wet with pure water. At the same time, an aqueous solution of colloidal silica is sprayed for bonding phosphor powders and for bonding any one of the phosphors and the glass substrate. After that, resin intermediate layer forming 30 is performed by subsequently spraying a solution of acrylic lacquer in toluene on the resultant.

Further, the substrate is set in an EB evaporator, and aluminum is deposited from the vapor, and thereby formation 31 of an aluminum back serving as a metal back 7 is performed. Finally, the result is heated in the air for 1 hour so as to be subjected to baking 32, and thereby the resin intermediate layer is removed and the face plate 1 is completed. The heating is performed at a temperature of about 450° C.

A rear plate 4 on which an electron-emitting device is formed can be produced by the following method.

First, wires are formed by repeating screen printing with an Ag paste and an insulating paste, drying, and baking, on the upper portion of a glass substrate cleaned in the same manner as in the case of the face plate.

Next, after the formation of the above wires, an electron-emitting device is formed at a position where the wires intersect. In this example, an electron-emitting device of a type called a Spindt type was formed at a position in alignment with a phosphor provided on the face-side substrate.

Subsequently, a closed container is formed by having the aluminum-backed face plate and the above rear plate face toward each other through a 1.6-t glass peripheral supporting frame to which a lead frit is applied, and, for example, performing a heating treatment while being pressurized. Further, the FED panel as a vacuum container can be obtained by connecting it to an appropriate exhaust system through, for example, an exhaust pipe to be sufficiently evacuated, and, after that, providing a sealing treatment.

It should be noted that, in each of the comparative example and the examples, a black matrix in which 1,920 apertures each measuring 0.3 mm by 0.7 mm were formed in an x direction at a pitch of 0.5 mm, and 480 apertures of the same type were formed in a y direction at a pitch of 1.5 mm, was used. As a result, an FED panel the display resolution of which corresponds to that of a VGA in which the number of scanning lines is 480 was obtained.

Aluminum serving as a metal back 7 was formed into a film having a thickness of 80 nm, and the resin intermediate layer was removed through baking by heating in the air at 450° C. for 1 hour.

A Spindt type device was used as an electron-emitting device.

Comparative Example

In this comparative example, ZnS:Ag, Cl was used as a blue phosphor, ZnS:Cu, Al was used as a green phosphor, and $Y_2O_2S:Eu^{3+}$ was used as a red phosphor. A P22-B1 manufactured by Kasei Optonix, Ltd. was used as the blue phosphor, a P22-GN4 manufactured by Kasei Optonix, Ltd. was used as the green phosphor, and a P22-RE3 manufactured by Kasei Optonix, Ltd. was used as the red phosphor.

A drive circuit for an experiment was connected to the FED panel to form an FED. Motion image visibility when a frame frequency was changed was evaluated by moving a red character in a black background. For this purpose, the FED was connected to a personal computer in which a Windows 2000 OS manufactured by Microsoft® Corporation was installed.

The red character in the black background was moved by utilizing the "message board display" of a screen saver. Conditions set in this case were such that the color of a back surface was black, and a character "ninshiki" (meaning "recognition" in Japanese) was displayed in the following font: MS Mincho, a boldface, a size 144 and a red color.

Further, the speed was adjusted so that the character might move from the right of the screen to the left within 2 seconds.

Next, 100 arbitrarily sampled persons were caused to observe the screen of the screen saver from the same position, and an investigation was conducted on the difficulty with which each of the persons viewed the character when a line selection time was changed to 70 μs, 35 μs, 2 μs or 1 μs by changing the frame frequency. As a result, the following was found: two of the 100 persons felt difficulty in viewing the character at a line selection time of 70 μs; fifty-six of the persons felt difficulty in viewing the character at a line selection time of 35 μs; and all of the persons felt difficulty in viewing the character at a line selection time of 2 or 1 μs, and thus the motion image visibility was problematic.

Table 1 shows the results.

Subsequently, the FED panel was connected to a drive circuit for an experiment. An accelerating voltage was set to 10 kV, and the voltage at which each electron-emitting device was driven (hereinafter referred to as "driving voltage") was set so that the electron-emitting device could emit a current at a current density of 20 mA/cm$^2$. Then, the panel was caused to display a red monochromatic color according to progressive driving at a frame frequency of 60 Hz. A selection time in this case was 70 μs.

Subsequently, a radiance luminance meter (SR-3 manufactured by TOPCON® CORPORATION) was placed at a position distant from the face plate of the FED panel by 0.4 m. Next, the pulse width of the driving voltage was adjusted so as to be variable between 2 μs and 20 μs. Luminances Lv were plotted against the respective pulse widths Pw, and were regressed with the following equation (2).

$$Lv=C2\cdot Pw\delta \quad (2)$$

In the equation (2) above, C2 and δ are each a constant.

δ is a value showing luminance linearity with respect to a pulse width. In this comparative example, δ=0.85 was obtained, which indicates that the luminance linearity with respect to a pulse width in this example was insufficient.

In addition, a luminance and CIE chromaticity coordinates when the pulse width was 20 μs were measured. As a result, a relative luminance was 100, and the chromaticity coordinates (x, y) were (0.657, 0.336).

Table 1 lists the relative luminance.

Next, in a state where the pulse width was fixed at 20 μs, the driving voltage was adjusted so that the current density might be variable between 1 mA/cm$^2$ and 40 mA/cm$^2$. Luminances Lv were plotted against the respective current densities Je, and were regressed with the following equation (3).

$$LV=C3\cdot Je\gamma \quad (3)$$

In the equation (3) above, C3 and γ are each a constant.

γ is a value showing luminance linearity with respect to a current density. In this comparative example, γ=0.7 was obtained, which indicates that the luminance linearity with respect to a current density in this example was also insufficient.

In addition, the current density was fixed at 20 mA/cm$^2$, and the pulse width of the driving voltage was adjusted so that the luminance might be 100 cd/m$^2$. Then, each electron-emitting device was continuously driven for 10,000 hours. As a result, a luminance maintenance ratio sufficiently exceeded 95%.

Example 1

An FED panel was obtained in the same manner as in Comparative Example, except that a $CaAlSiN_3:Eu^{2+}$ phosphor (CASN) was used as the red phosphor.

CASN was synthesized in accordance with the following procedure.

First, Eu metal particles were loaded into a planetary ball mill apparatus under a 5% $H_2/N_2$ atmosphere, and were sufficiently pulverized with an appropriate amount of 1-mmϕ agate beads. Next, the pulverized Eu metal particles were taken out in a glove box under a 5% $H_2/N_2$ atmosphere.

Next, the pulverized Eu metal particles were loaded into a BN crucible, and the crucible was placed in a furnace in a vacuum tube state. After that, the particles were subjected to evacuation, and were heated at 600° C. for 4 hours while an ammonia gas was flowed into the tube at a flow rate of 2 L/min. Thus, high-purity EuN was obtained.

Next, EuN thus obtained was taken out in a glove box under a nitrogen atmosphere, and was mixed with $Ca_3N_2$, AlN and $Si_3N_4$ each at a stoichiometric ratio. The materials were mixed and pulverized with an agate mortar, and then the resultant mixture was sealed as it was in a BN crucible.

The BN crucible after the sealing was further sealed in a larger BN crucible so as not to be exposed to oxygen, and thereby a double crucible arrangement was provided.

The resultant crucible was placed in a high pressure sintering furnace and subjected to evacuation. After that, the crucible was heated to 1,800° C. at a rate of 600° C./h while a nitrogen atmosphere having a pressure of 9.5 atmospheric pressures was maintained. The crucible was maintained in the state for 7 hours, and was then slowly cooled to room temperature.

The sample mixture thus obtained was irradiated with black light so that a non-emission formation on the surface of the mixture might be carefully removed. Finally, the resultant mixture was sufficiently pulverized with an agate mortar.

The CASN phosphor thus synthesized showed a relatively dense orange body color, and its structure was identified by powder X-ray diffraction.

In addition, the concentration of each of Ca, Al and Si was identified by emission spectral analysis, and the phosphor was identified as $CaAlSiN_3:Eu^{2+}$.

It should be noted that the synthesis was performed so that the concentration of $Eu^{2+}$ would be 3 wt %.

The FED panel thus obtained was connected to a drive circuit and a personal computer in the same manner as in Comparative Example, and an investigation was conducted on the difficulty experience by a person in viewing a character, in the same manner as in Comparative Example.

In this example, of all frame frequencies, no one felt difficulty in viewing a character at a frame frequency corresponding to a selection time of 35 μs or 70 μs. In addition, one person felt difficulty in viewing the character at a selection time of 2 μs, and thirty-one persons felt difficulty in viewing the character at a selection time of 1 μs. Accordingly, it was found that the panels each had excellent motion image visibility at a selection time of 2 μs or more.

Table 1 lists the results.

In addition, δ determined in the same manner as in Comparative Example was 1, which indicated that the luminance linearity with respect to a pulse width was excellent.

Further, γ determined in the same manner as in Comparative Example was 1, which indicated that the luminance linearity with respect to a current density was also excellent.

In addition, a relative luminance and CIE chromaticity coordinates were measured in the same manner as in Comparative Example. As a result, the relative luminance was determined to be 58, and the CIE chromaticity coordinates (x, y) were determined to be (0.670, 0.328), and thus it was found that the FED panel showed a red color having a better purity than that in the Comparative Example.

Table 1 lists these values as well.

It was found that, because the luminance linearity with respect to a current density was excellent, the luminance at a current density Je of 33 mA/cm$^2$ exceeded that in the Comparative Example.

Further, continuous driving was performed under conditions identical to those of Comparative Example. As a result, a luminance maintenance ratio sufficiently exceeded 95%.

Example 2

In each of Examples 2 to 7, a mixed alkaline earth silicate phosphor represented by the following general formula $M1_1M2_mSi_2O_6:Eu^{2+}$, where M1 and M2 each represented any of Ba, Sr, Ca and Mg, was layered on the red phosphor of Example 1. After a stripe had been formed by using a CASN phosphor paste, the phosphor represented by the general formula $M1_1M2_mSi_2O_6:Eu^{2+}$ was printed in an overlapping fashion by repeating the steps 27 to 29 of FIG. 3, and thereby a two-layer structure was provided.

In this example (Example 2), a $Ca_1Mg_mSi_2O_6:Eu^{2+}$ phosphor was used as the phosphor represented by the general formula $M1_1M2_mSi_2O_6:Eu^{2+}$.

A precursor for the $Ca_1Mg_mSi_2O_6:Eu^{2+}$ phosphor was prepared as described below. Calcium carbonate, magnesium oxide and silicon oxide metered in accordance with the stoichiometric composition were sufficiently pulverized with an agate mortar. After that, europium chloride was added at a content of 3 wt % in terms of Eu to the resultant mixture, and the mixture was further sufficiently pulverized with the agate mortar. After that, the mixture was dispersed in a beaker filled with pure water, stirred with a magnetic stirrer for 24 hours, filtrated and dried, thereby a precursor was prepared.

The precursor was loaded into a 60-cc alumina crucible, and was subjected to baking with an electric furnace in the air at 1,350° C. for 2 hours.

After the baking, the baked product was taken out of the alumina crucible, and was sufficiently pulverized with an agate mortar. After that, the pulverized products were packed in the alumina crucible again. The alumina crucible was further placed in a 200-cc alumina crucible, and the periphery of the smaller crucible was filled with activated carbon, thereby a double crucible was provided.

The double crucible was placed in an electric furnace, and was subjected to baking in a reducing atmosphere at 1,200° C. for 2 hours by flowing a 5% $H_2/N_2$ gas at a rate of 1 L/min.

After the baking, the baked product was taken out of the alumina crucible, and was sampled in a beaker while being elutriated with a nylon 100-mesh sieve. The beaker was filled with pure water, and the contents in the beaker were sufficiently stirred with a magnetic stirrer. After that, the mixture was left at rest, and the supernatant was removed; the foregoing cleaning was repeated five times.

After that, the resultant was filtrated and dried, and then the $Ca_1Mg_mSi_2O_6:Eu^{2+}$ phosphor was obtained.

A value for each of 1 and m can be adjusted depending on the chemical composition of loaded materials; three kinds of phosphors in each of which l+m was 1.0, 2.0 or 3.0 were synthesized.

Figure 3:
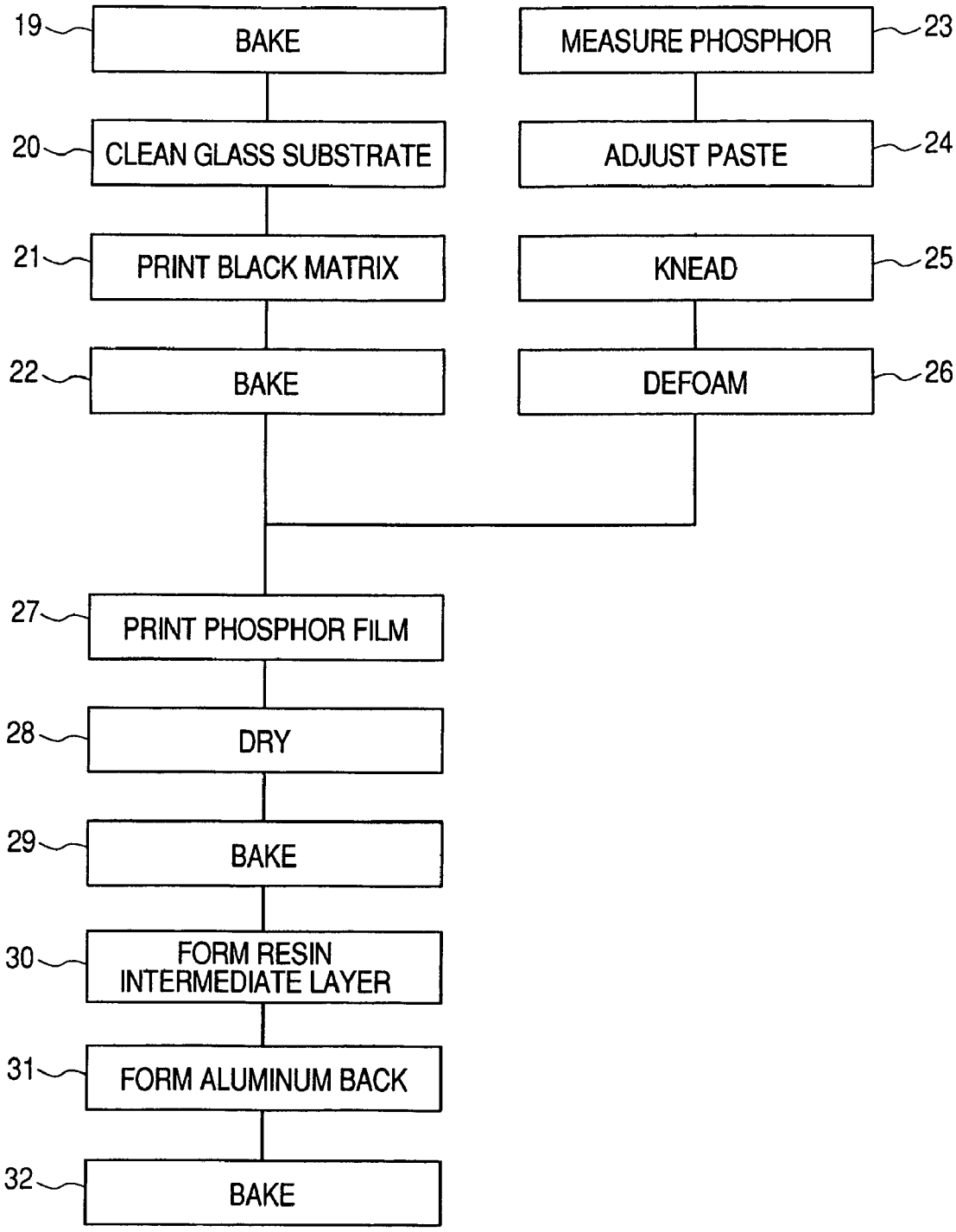
FIG. 3 is a flow chart for an embodiment of a production of an aluminum-backed fluorescent screen, as used in Examples.

Each of those three kinds of $Ca_1Mg_mSi_2O_6:Eu^{2+}$ phosphors was turned into a paste as in the case of Comparative Example by the method shown in the steps 23 to 26 of FIG. 3.

Next, an FED panel was produced in the same manner as in Comparative Example.

The three kinds of FED panels different from one another in l+m thus obtained were each evaluated for its motion image visibility under conditions identical to those of Comparative Example.

In this example, irrespective of the value for l+m, no one felt difficulty in viewing a character at a frame frequency corresponding to a selection time of 35 μs or 70 μs. In addition, two or less persons felt difficulty in viewing the character at a selection time of 2 μs, and thirty-six or more persons felt difficulty in viewing the character at a selection time of 1 μs. Accordingly, it was found that the panels each had excellent motion image visibility at a selection time of 2 μs or more.

Table 1 lists the results.

In addition, δ determined in the same manner as in Comparative Example was 1 irrespective of the value for l+m, indicating that the luminance linearity with respect to a pulse width in this example was excellent.

Further, γ determined in the same manner as in Comparative Example was 1 irrespective of the value for l+m, indicating that the luminance linearity with respect to a current density in this example was also excellent.

In addition, a relative luminance and CIE chromaticity coordinates were measured in the same manner as in Comparative Example. As a result, the relative luminance was 57 for l+m=1, 113 for l+m=2, or 56 for l+m=3, and thus it was found that a higher luminance was obtained for l+m=2 than those in Comparative Example and Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.670, 0.328) irrespective of the value for l+m, and thus it was found that the FED panels each showed a red color having a better purity than that in Comparative Example.

Further, continuous driving was performed under conditions identical to those of Comparative Example. As a result, a luminance maintenance ratio sufficiently exceeded 95% irrespective of the value for l+m.

Example 3

Three kinds of $Sr_1Mg_mSi_2O_6:Eu^{2+}$ phosphors in each of which l+m was 1.0, 2.0 or 3.0 were each synthesized by using strontium carbonate, magnesium oxide and silicon oxide as starting materials in the same manner as in Example 2.

FED panels each including a red sub-pixel having a two-layer phosphor structure were each produced by using any one of those three kinds of $Sr_1Mg_mSi_2O_6:Eu^{2+}$ phosphors in the same manner as in Example 2.

The three kinds of FED panels different from one another in l+m thus obtained were each connected to a personal computer in the same manner as in Comparative Example, and an investigation was conducted on the difficulty with which a person viewed a character in the same manner as in Comparative Example.

In this example, irrespective of the value for l+m, no one felt difficulty in viewing a character at a frame frequency corresponding to a selection time of 35 us or 70 μs. In addition, two or less persons felt difficulty in viewing the character at a selection time of 2 μs, and thirty-five or more persons felt difficulty in viewing the character at a selection time of 1 μs. Accordingly, it was found that the panels each had excellent motion image visibility at a selection time of 2 μs or more.

Table 1 lists the results.

In addition, δ determined in the same manner as in the Comparative Example was 1 irrespective of the value for l+m, indicating that the luminance linearity with respect to a pulse width in this example was excellent.

Further, γ determined in the same manner as in the Comparative Example was 1 irrespective of the value for l+m, indicating that the luminance linearity with respect to a current density in this example was also excellent.

In addition, a relative luminance and CIE chromaticity coordinates were measured in the same manner as in the Comparative Example. As a result, the relative luminance was 23 for l+m=1, 63 for l+m=2, or 38 for l+m=3, and thus it was found that a higher luminance was obtained for l+m=2 than that in Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.669, 0.328) irrespective of the value for l+m, and thus it was found that the FED panels each showed a red color having a better purity than that in the Comparative Example.

Further, continuous driving was performed under conditions identical to those of the Comparative Example. As a result, a luminance maintenance ratio sufficiently exceeded 95% irrespective of the value for l+m.

Example 4

Three kinds of $Ba_1Mg_mSi_2O_6:Eu^{2+}$ phosphors in each of which l+m was 1.0, 2.0 or 3.0 were each synthesized by using barium carbonate, magnesium oxide and silicon oxide as starting materials in the same manner as in Example 2.

FED panels each including a red sub-pixel having a two-layer phosphor structure were each produced by using any one of those three kinds of $Ba_1Mg_mSi_2O_6:Eu^{2+}$ phosphors in the same manner as in Example 2.

The three kinds of FED panels different from one another in l+m thus obtained were each connected to a personal computer in the same manner as in Comparative Example, and an investigation was conducted on the difficulty experience by a person in viewing a character in the same manner as in the Comparative Example.

In this example, irrespective of the value for l+m, no one felt difficulty in viewing a character at a frame frequency corresponding to a selection time of 35 μs or 70 μs. In addition, two or less persons felt difficulty in viewing the character at a selection time of 2 μs, and thirty-four or more persons felt difficulty in viewing the character at a selection time of 1 μs. Accordingly, it was found that the panels each had excellent motion image visibility at a selection time of 2 μs or more.

Table 1 lists the results.

In addition, δ determined in the same manner as in the Comparative Example was 1 irrespective of the value for l+m, indicating that the luminance linearity with respect to a pulse width in this example was excellent.

Further, γ determined in the same manner as in the Comparative Example was 1 irrespective of the value for l+m, indicating that the luminance linearity with respect to a current density in this example was also excellent.

In addition, a relative luminance and CIE chromaticity coordinates were measured in the same manner as in the Comparative Example. As a result, the relative luminance was 54 for l+m=1, 102 for l+m=2, or 50 for l+m=3, and thus it was found that a higher luminance was obtained for l+m=2 than those in Comparative Example and Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.668, 0.329) irrespective of the value for l+m, and thus it was found that the FED panels each showed a red color having a better purity than that in the Comparative Example.

Further, continuous driving was performed under conditions identical to those of the Comparative Example. As a result, a luminance maintenance ratio sufficiently exceeded 95% irrespective of the value for l+m.

Example 5

Three kinds of $Sr_1Ca_mSi_2O_6:Eu^{2+}$ phosphors in each of which l+m was 1.0, 2.0 or 3.0 were each synthesized by using strontium carbonate, calcium carbonate and silicon oxide as starting materials in the same manner as in Example 2.

FED panels each including a red sub-pixel having a two-layer phosphor structure were each produced by using any one of those three kinds of $Sr_1Ca_mSi_2O_6:Eu^{2+}$ phosphors in the same manner as in Example 2.

The three kinds of FED panels different from one another in l+m thus obtained were each connected to a personal computer in the same manner as in the Comparative Example, and an investigation was conducted on the difficulty experienced by a person in viewing a character in the same manner as in the Comparative Example.

In this example, irrespective of the value for l+m, no one felt difficulty in viewing a character at a frame frequency corresponding to a selection time of 35 us or 70 μs. In addition, two or less persons felt difficulty in viewing the character at a selection time of 2 μs, and thirty-five or more persons felt difficulty in viewing the character at a selection time of 1 μs. Accordingly, it was found that the panels each had excellent motion image visibility at a selection time of 2 μs or more.

Table 1 lists the results.

In addition, δ determined in the same manner as in the Comparative Example was 1 irrespective of the value for l+m, indicating that the luminance linearity with respect to a pulse width in this example was excellent.

Further, γ determined in the same manner as in the Comparative Example was 1 irrespective of the value for l+m, indicating that the luminance linearity with respect to a current density in this example was also excellent.

In addition, a relative luminance and CIE chromaticity coordinates were measured in the same manner as in the Comparative Example. As a result, the relative luminance was 23 for l+m=1, 63 for l+m=2, or 34 for l+m=3, and thus it was found that a higher luminance was obtained for l+m=2 than that in Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.668, 0.329) irrespective of the value for l+m, and thus it was found that the FED panels each showed a red color having a better purity than that in the Comparative Example.

Further, continuous driving was performed under conditions identical to those of the Comparative Example. As a result, a luminance maintenance ratio sufficiently exceeded 95% irrespective of the value for l+m.

Example 6

Three kinds of $Ba_1Ca_mSi_2O_6:Eu^{2+}$ phosphors in each of which l+m was 1.0, 2.0 or 3.0 were each synthesized by using barium carbonate, calcium carbonate and silicon oxide as starting materials in the same manner as in Example 2.

FED panels each including a red sub-pixel having a two-layer phosphor structure were each produced by using any one of those three kinds of $Ba_1Ca_mSi_2O_6:Eu^{2+}$ phosphors in the same manner as in Example 2.

The three kinds of FED panels different from one another in l+m thus obtained were each connected to a personal computer in the same manner as in Comparative Example, and an investigation was conducted on the difficulty experienced by a person in viewing a character in the same manner as in the Comparative Example.

In this example, irrespective of the value for l+m, no one felt difficulty in viewing a character at a frame frequency corresponding to a selection time of 35 μs or 70 μs. In addition, two or less persons felt difficulty in viewing the character at a selection time of 2 μs, and thirty-six or more persons felt difficulty in viewing the character at a selection time of 1 μs. Accordingly, it was found that the panels each had excellent motion image visibility at a selection time of 2 μs or more.

In addition, δ determined in the same manner as in the Comparative Example was 1 irrespective of the value for l+m, indicating means that the luminance linearity with respect to a pulse width in this example was excellent.

Further, γ determined in the same manner as in the Comparative Example was 1 irrespective of the value for l+m, indicating that the luminance linearity with respect to a current density in this example was also excellent.

In addition, CIE chromaticity coordinates were measured in the same manner as in the Comparative Example. As a result, the relative luminance was 36 for l+m=1, 72 for l+m=2, or 54 for l+m=3, and thus it was found that a higher luminance was obtained for l+m=2 than that in Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.668, 0.329) irrespective of the value for l+m, and thus it was found that the FED panels each showed a red color having a better purity than that in the Comparative Example.

Further, continuous driving was performed under conditions identical to those of the Comparative Example. As a result, a luminance maintenance ratio sufficiently exceeded 95% irrespective of the value for l+m.

Example 7

Three kinds of $Ba_1Sr_mSi_2O_6:Eu^{2+}$ phosphors in each of which l+m was 1.0, 2.0 or 3.0 were each synthesized by using barium carbonate, strontium carbonate and silicon oxide as starting materials in the same manner as in Example 2.

FED panels each including a red sub-pixel having a two-layer phosphor structure were each produced by using any one of those three kinds of $Ba_1Sr_mSi_2O_6:Eu^{2+}$ phosphors in the same manner as in Example 2.

The three kinds of FED panels different from one another in l+m thus obtained were each connected to a personal computer in the same manner as in the Comparative Example, and an investigation was conducted on the difficulty experienced by a person in viewing a character in the same manner as in the Comparative Example.

In this example, irrespective of the value for l+m, no one felt difficulty in viewing a character at a frame frequency corresponding to a selection time of 2 μs, 35 μs or 70 μs. In addition, thirty-four or more persons felt difficulty in viewing the character at a selection time of 1 μs. Accordingly, it was found that the panels each had excellent motion image visibility at a selection time more than 1 μs.

Table 1 lists the results.

In addition, δ determined in the same manner as in the Comparative Example was 1 irrespective of the value for l+m, indicating that the luminance linearity with respect to a pulse width in this example was excellent.

Further, γ determined in the same manner as in the Comparative Example was 1 irrespective of the value for l+m, indicating that the luminance linearity with respect to a current density in this example was also excellent.

In addition, a relative luminance and CIE chromaticity coordinates were measured in the same manner as in the Comparative Example. As a result, the relative luminance was 32 for l+m=1, 68 for l+m=2, or 51 for l+m=3, and thus it was found that a higher luminance was obtained for l+m=2 than that in Example 1.

On the other hand, for l+m=1 or 3, the luminance was lower than that in Example 1, and thus little or no effect of adopting a two-layer phosphor arrangement could be observed.

Table 1 lists those values as well.

In addition, the CIE chromaticity coordinates (x, y) were (0.668, 0.329) irrespective of the value for l+m, and thus it was found that the FED panels each showed a red color having a better purity than that in the Comparative Example.

Further, continuous driving was performed under conditions identical to those of the Comparative Example. As a result, a luminance maintenance ratio sufficiently exceeded 95% irrespective of the value for l+m.

TABLE 1

| | Constitution of red phosphor | | | The number of persons who felt difficulty in viewing character out of 100 persons | | | | Luminance when the luminance of the Comparative Example is set to 100 |
|---|---|---|---|---|---|---|---|---|
| | First layer | Second layer | | Selection time t = 1 μs | Selection time t = 2 μs | Selection time t = 35 μs | Selection time t = 70 μs | |
| Comparative Example | $Y_2O_2S:Eu^{3+}$ | None | | 100 | 100 | 56 | 2 | 100 |
| Example 1 | $CaAlSiN_3:Eu^{2+}$ | None | | 31 | 1 | 0 | 0 | 58 |
| Example 2 | $CaAlSiN_3:Eu^{2+}$ | $Ca_lMg_mSi_2O_6:Eu^{2+}$ | l + m = 1 | 36 | 2 | 0 | 0 | 57 |
| | $CaAlSiN_3:Eu^{2+}$ | $Ca_lMg_mSi_2O_6:Eu^{2+}$ | l + m = 2 | 37 | 1 | 0 | 0 | 113 |
| | $CaAlSiN_3:Eu^{2+}$ | $Ca_lMg_mSi_2O_6:Eu^{2+}$ | l + m = 3 | 36 | 0 | 0 | 0 | 56 |
| Example 3 | $CaAlSiN_3:Eu^{2+}$ | $Sr_lMg_mSi_2O_6:Eu^{2+}$ | l + m = 1 | 35 | 2 | 0 | 0 | 23 |
| | $CaAlSiN_3:Eu^{2+}$ | $Sr_lMg_mSi_2O_6:Eu^{2+}$ | l + m = 2 | 36 | 1 | 0 | 0 | 63 |
| | $CaAlSiN_3:Eu^{2+}$ | $Sr_lMg_mSi_2O_6:Eu^{2+}$ | l + m = 3 | 37 | 0 | 0 | 0 | 38 |

TABLE 1-continued

| | Constitution of red phosphor | | | The number of persons who felt difficulty in viewing character out of 100 persons | | | | Luminance when the luminance of the Comparative Example is set to 100 |
|---|---|---|---|---|---|---|---|---|
| | First layer | Second layer | | Selection time t = 1 μs | Selection time t = 2 μs | Selection time t = 35 μs | Selection time t = 70 μs | |
| Example 4 | $CaAlSiN_3:Eu^{2+}$ | $Ba_lMg_mSi_2O_6:Eu^{2+}$ | l + m = 1 | 35 | 2 | 0 | 0 | 54 |
| | $CaAlSiN_3:Eu^{2+}$ | $Ba_lMg_mSi_2O_6:Eu^{2+}$ | l + m = 2 | 36 | 0 | 0 | 0 | 102 |
| | $CaAlSiN_3:Eu^{2+}$ | $Ba_lMg_mSi_2O_6:Eu^{2+}$ | l + m = 3 | 34 | 0 | 0 | 0 | 50 |
| Example 5 | $CaAlSiN_3:Eu^{2+}$ | $Sr_lCa_mSi_2O_6:Eu^{2+}$ | l + m = 1 | 35 | 1 | 0 | 0 | 23 |
| | $CaAlSiN_3:Eu^{2+}$ | $Sr_lCa_mSi_2O_6:Eu^{2+}$ | l + m = 2 | 36 | 2 | 0 | 0 | 63 |
| | $CaAlSiN_3:Eu^{2+}$ | $Sr_lCa_mSi_2O_6:Eu^{2+}$ | l + m = 3 | 37 | 1 | 0 | 0 | 34 |
| Example 6 | $CaAlSiN_3:Eu^{2+}$ | $Ba_lCa_mSi_2O_6:Eu^{2+}$ | l + m = 1 | 36 | 0 | 0 | 0 | 36 |
| | $CaAlSiN_3:Eu^{2+}$ | $Ba_lCa_mSi_2O_6:Eu^{2+}$ | l + m = 2 | 36 | 0 | 0 | 0 | 72 |
| | $CaAlSiN_3:Eu^{2+}$ | $Ba_lCa_mSi_2O_6:Eu^{2+}$ | l + m = 3 | 36 | 2 | 0 | 0 | 54 |
| Example 7 | $CaAlSiN_3:Eu^{2+}$ | $Ba_lSr_mSi_2O_6:Eu^{2+}$ | l + m = 1 | 35 | 0 | 0 | 0 | 32 |
| | $CaAlSiN_3:Eu^{2+}$ | $Ba_lSr_mSi_2O_6:Eu^{2+}$ | l + m = 2 | 34 | 0 | 0 | 0 | 68 |
| | $CaAlSiN_3:Eu^{2+}$ | $Ba_lSr_mSi_2O_6:Eu^{2+}$ | l + m = 3 | 36 | 0 | 0 | 0 | 51 |

As described in the examples above, an embodiment of the FED panel according to aspects of the present invention in which a pixel having of a red phosphor, or having a layered structure of a red phosphor and a mixed alkaline earth silicate phosphor represented by the general formula $M1_lM2_mSi_2O_6:Eu^{2+}$, where M1 and M2 each represent any of Ba, Sr, Ca and Mg, and l+m satisfies the relationship of $1<l+m<3$, is formed, is excellent in motion image response with respect to a selection time, and also luminance linearity with respect to a selection time and a charge density.

Also, because an FED panel having good motion image response with respect to a selection time can be obtained, not only the conventional gradation display in which a charge density (current density) is changed but also gradation display in which a selection time is changed or gradation display in which a charge density and a selection time are changed, can be performed.

According to the above examples, there can be provided an FED having the following characteristic: even when a motion image is displayed under such a condition that a selection time is short, the visibility of the motion image is good.

In one version, the use of the FED panel in accordance with aspects of the present invention can be provided as a part of an image display apparatus as well as an electronic instrument mounted with the image display apparatus. The electronic instrument mounted with the image display apparatus can be used in a general apparatus that displays an image signal as an image, examples of which apparatus can include at least one of a television receiver and an integral personal computer.

According to one embodiment, image information supplied through a line, such as for example one or more of radio broadcasting, wire broadcasting, and the internet may be subjected to modulation, and, furthermore, may be subjected to encoding such as compression or encryption. An image information receiving circuit selects image information from multiple pieces of image information supplied from the line. The image information selected by the image information receiving circuit is subjected to modulation and decoding by an image signal generation circuit, and thereby an image signal is obtained.

In one version, the drive circuit may supply a signal for display to the FED panel on the basis of the supplied image signal. An image may be displayed on the FED panel on the basis of the signal supplied from the drive circuit.

Decoding may not be performed when the image information has not been subjected to encoding.

In one version, when the image display apparatus is caused to display an image on the basis of the image information of a recording medium recording the information, the image information recorded in the recording medium may be read out with a readout circuit that reads out the image information from the recording medium. When the image information thus read out is subjected to encoding, the image information may be subjected to decoding by the image signal generation circuit, and thereby an image signal is obtained. The resultant image signal may be supplied to the drive circuit. The drive circuit may supply a signal for display to the FED panel on the basis of the supplied image signal. An image may be displayed on the FED panel on the basis of the signal supplied from the drive circuit.

When the image information thus read out is not subjected to encoding, the image information thus read out may be equivalent to an image signal. The image signal thus read out may be supplied to the drive circuit. The drive circuit can supply a signal for display to the FED panel on the basis of the supplied image signal. An image may be displayed on the FED panel on the basis of the signal supplied from the drive circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-040110, filed Feb. 21, 2008, which is hereby incorporated by reference herein in its entirety.

What is claimed is:

1. An image display apparatus comprising:

a rear plate having a plurality of electron-emitting devices;

a face plate having a plurality of pixels, each pixel having one or more phosphors that emit fluorescence in response to electrons emitted from the electron-emitting devices; and a drive circuit configured to drive the electron-emitting devices with line-sequential driving manner, wherein in at least one pixel of the pixels, a first phosphor and a second phosphor are layered on a substrate of the face plate in order of the second phosphor and then the first phosphor, the first phosphor emits fluorescence in response to the electrons emitted from the electron-emitting devices, and the second phosphor emits, in response to the fluorescence emitted from the first phosphor, a visible light by which the pixel forms an image, the first phosphor is a mixed alkaline earth silicate phosphor represented by $M1_lM2_mSi_2O_6:Eu^{2+}$, where M1 and M2 are any of Ba, Sr, Ca or Mg, and $1<l+m<3$, and the second phosphor is $CaAlSiN_3:Eu^{2+}$.

2. The image display apparatus according to claim 1, wherein the fluorescence of the first phosphor emitted in response to the electrons ranges from a near-ultraviolet to a visible light region.

3. The image display apparatus according to claim 1, wherein the fluorescence of the first phosphor emitted in response to the electrons has a wavelength that is within an excitation band of the second phosphor.

4. The image display apparatus according to claim 1, wherein a luminance of the second phosphor that is emitted in response to the emission by the first phosphor is greater than a luminance of the second phosphor that would be emitted in response to the electrons.

5. The image display apparatus according to claim 1, wherein the pixel has a blue phosphor that emits blue emission and a green phosphor that emits green emission, in response to the electrons emitted from the electron-emitting devices.

6. The image display apparatus according to claim 1, wherein the first phosphor comprises any of $Ca_lMg_mSi_2O_6:Eu^{2+}$, $Sr_lMg_mSi_2O_6:Eu^{2+}$, $Ba_lMg_mSi_2O_6:Eu^{2+}$, $Sr_lCa_mSi_2O_6:Eu^{2+}$, $Ba_lCa_mSi_2O_6:Eu^{2+}$and $Ba_lR_mSi_2O_6:Eu^{2+}$, where $1<l+m<3$.

7. The image display apparatus according to claim 1, wherein the apparatus comprises a field emission display (FED).

* * * * *